US008113471B2

(12) United States Patent
Parisi et al.

(10) Patent No.: US 8,113,471 B2
(45) Date of Patent: Feb. 14, 2012

(54) DECODER FOR A STATIONARY SWITCH MACHINE

(76) Inventors: Anthony R. Parisi, Richmond, VT (US); Larry Meier, New Haven, VT (US)

( * ) Notice: Subject to any disclaimer, the term of this patent is extended or adjusted under 35 U.S.C. 154(b) by 0 days.

(21) Appl. No.: 12/881,681

(22) Filed: Sep. 14, 2010

(65) Prior Publication Data

US 2011/0062291 A1 Mar. 17, 2011

Related U.S. Application Data

(63) Continuation of application No. 11/458,428, filed on Jul. 19, 2006, now Pat. No. 7,810,761, which is a continuation-in-part of application No. 11/341,893, filed on Jan. 30, 2006, now Pat. No. 7,810,760.

(60) Provisional application No. 60/647,438, filed on Jan. 28, 2005, provisional application No. 60/707,547, filed on Aug. 12, 2005.

(51) Int. Cl.
*B61L 25/00* (2006.01)

(52) U.S. Cl. ..... 246/122 A; 246/1 C; 246/415 A

(58) Field of Classification Search ..... 246/122 A, 246/122 R, 134, 1 R, 1 C, 3, 5, 220, 219, 246/253, 473 A, 131, 132, 133, 143, 146, 246/160, 162, 415 A
See application file for complete search history.

(56) References Cited

U.S. PATENT DOCUMENTS

| | | | |
|---|---|---|---|
| 4,695,016 | A | 9/1987 | Worack |
| 6,308,920 | B1 | 10/2001 | Zander |
| 6,530,329 | B2 | 3/2003 | Katzer |
| 7,350,754 | B2 | 4/2008 | Pierson |

OTHER PUBLICATIONS

Digitrax manual and instruction: DS54 Quad Stationary Decoder for Digital Command Control with Programmable LocoNet Inputs & Outputs, pp. 1-65, Digitrax, Inc., last updated Jul. 2003.
The Digitrax, Big Book of DCC, sections 5.2-5.4, pp. 62-66, Digitrax, Inc., Copyright 1999.
The Digitrax, Big Book of DCC, Figures 7-11, pp. 100-102, Digitrax, Inc., Copyright 1999.
"Switch-It Accessory Decoder," NCE Corporation, 4 pages, Revised Mar. 2003.
Digital Command Control, The Comprehensive Guide to DCC, pp. 37, 41, Stan Ames et al., 1998.

*Primary Examiner* — Mark Le
(74) *Attorney, Agent, or Firm* — Edell, Shapiro & Finnan, LLC

(57) ABSTRACT

A method for controlling a model railroad stationary switch machine comprising sensing whether a train occupies a main track section near a track switch that connects between said main track section and at least two diverging track sections. An automatic switch control function for the track switch is inhibited in response to sensing that a train occupies the main track section near the track switch when a train is determined to be approaching the track switch on at least one of the diverging track sections. In addition, a method is provided for controlling a model railroad track switch comprising changing a position of the track switch, and automatically returning the track switch to a home position after expiration of a time interval following the changing of the track switch position.

12 Claims, 8 Drawing Sheets

220
230
280
290
300
400
240A
240B
1-2 PROGRAM
2-3 OPERATE
J2
J2-1
J2-2
J2-3
260
J4
TORTOISE
CONNECTOR
J4-1
J4-2
J4-3
J4-4
J4-5
J4-6
J4-7
J4-8
260
J5
TORTOISE
SWITCH
CONTACTS
J5-1
J5-2
J5-3
J5-4
J5-5
J5-6
J5-7
J5-8
270
295
J3
POSITION
FEEDBACK
THROW
CLEAR
J3-1
J3-2
J3-3
J3-4
J1-1
J1-2
J1-3
J1-4
J1-5
J1-6
J1-7
J1-8
J1-9
J1-10
J1-11
J1-12
THROW RAIL
CLEAR RAIL
THROW FROG
CLEAR FROG
ELECTRO FROG
THROW LED -
LED COMMON +
CLEAR LED -
MANUAL THROW
MANUAL CLEAR
CONTROL COMMON
POINT REVERSE
210

| ADDRESS | PROGRAMMED ADDRESS | ROUTE COMMAND | FOLLOW OR REVERSE COMMAND | ROUTE / SWITCH POSITION CV | PROGRAMMED CV VALUE |
|---|---|---|---|---|---|
| PRIMARY | 10 | | | 49 | |
| #1 ROUTE | 100 | CLEAR | FOLLOW | 50 | 0 |
| #2 ROUTE | 101 | THROW | FOLLOW | 51 | 0 |

| ADDRESS | PROGRAMMED ADDRESS | ROUTE COMMAND | FOLLOW OR REVERSE COMMAND | ROUTE / SWITCH POSITION CV | PROGRAMMED CV VALUE |
|---|---|---|---|---|---|
| PRIMARY | 11 | | | 49 | |
| #1 ROUTE | 100 | CLEAR | FOLLOW | 50 | 0 |
| #2 ROUTE | 101 | THROW | FOLLOW | 51 | 0 |

| ADDRESS | PROGRAMMED ADDRESS | ROUTE COMMAND | FOLLOW OR REVERSE COMMAND | ROUTE / SWITCH POSITION CV | PROGRAMMED CV VALUE |
|---|---|---|---|---|---|
| PRIMARY | 12 | | | 49 | |
| #1 ROUTE | 100 | CLEAR | FOLLOW | 50 | 0 |
| #2 ROUTE | 101 | THROW | REVERSE | 51 | 1 |

FIG.6B

CHART FOR SWITCH ADDRESS

LOCATION OR TURNOUT _____ DATE _____

| PRIMARY ADDRESS | ADDRESS NUMBER | SMART ROUTE COMMAND CLEAR OR THROWN | FOLLOW OR REVERSE SMART ROUTE COMMAND, ALWAYS THROWN, OR ALWAYS CLEAR | CV VALUE | CV | CV VALUES USED |
|---|---|---|---|---|---|---|
| PRIMARY ADDRESS | | | N/A | | 49 | 0, 1 |
| #1 ROUTE ADDRESS | | | | | 50 | 0, 1, 2, 3 |
| #2 ROUTE ADDRESS | | | | | 51 | 0, 1, 2, 3 |
| #3 ROUTE ADDRESS | | | | | 52 | 0, 1, 2, 3 |
| #4 ROUTE ADDRESS | | | | | 53 | 0, 1, 2, 3 |
| #5 ROUTE ADDRESS | | | | | 54 | 0, 1, 2, 3 |
| #6 ROUTE ADDRESS | | | | | 55 | 0, 1, 2, 3 |
| #7 ROUTE ADDRESS | | | | | 56 | 0, 1, 2, 3 |
| #8 ROUTE ADDRESS | | | | | 57 | 0, 1, 2, 3 |
| #9 ROUTE ADDRESS | | | | | 58 | 0, 1, 2, 3 |
| #10 ROUTE ADDRESS | | | | | 59 | 0, 1, 2, 3 |
| #11 ROUTE ADDRESS | | | | | 60 | 0, 1, 2, 3 |
| #12 ROUTE ADDRESS | | | | | 61 | 0, 1, 2, 3 |
| #13 ROUTE ADDRESS | | | | | 62 | 0, 1, 2, 3 |
| | | | POINTER AND RESET | | 63 | 0-13, 42 |
| | | | POWER UP POSITION | | 64 | 0, 2, 3 |
| | | | PROGRAMMABLE POINT SPEED | | 65 | 0-15 |
| | | | DISPATCHER OVER-RIDE AUTO-THROW LOCK-OUT | | 66 | 0, 1 |
| | | | AUTO THROW TIMER (AUTO THROW INHIBIT TIME) | | 67 | 0-255 |
| | | | SEMAPHORE OPS MODE | | 68 | 0, 1 |

FIG.7

DECODER FOR A STATIONARY SWITCH MACHINE

CROSS-REFERENCE TO RELATED APPLICATIONS

This application is a continuation of U.S. application Ser. No. 11/458,428, filed Jul. 19, 2006, now U.S. Pat. No. 7,810,761, which in turn is a continuation-in-part of U.S. application Ser. No. 11/341,893, filed Jan. 30, 2006, now U.S. Pat. No. 7,810,760, which in turn claims priority from U.S. Provisional Patent Application Ser. No. 60/647,438, filed Jan. 28, 2005 and entitled "Stationary Decoder for Model Railroads," and from U.S. Provisional Patent Application Ser. 60/707,547, filed Aug. 12, 2005 and entitled "Stationary Decoder for Model Railroads." The disclosures of the above-mentioned non-provisional and provisional applications are incorporated herein by reference in their entireties.

FIELD OF THE INVENTION

The present invention relates to an accessory decoder for a railway system and, in particular, to a stationary decoder for a slow motion switch machine used in a model railroad system.

BACKGROUND

Model railway systems have traditionally been constructed with of a set of interconnected sections of track, electric switches between different sections of the track, and other electrically operated devices, such as train engines and draw bridges. The track sections include straight, curved, and turnout sections. FIG. 1 illustrates a track section 50 for a model railway. As illustrated, the track section 50, comprising a turnout, includes a main pathway (called a mainline) and one or more diverging pathways. A point rail 60 can be repositioned with respect to the pathways to allow a train to enter a desired route. The portion of the turnout 50 which is grooved for the wheel flanges of the track is called a frog 70. The frog 70 permits the wheel flanges of cars taking one route to "pass through" the railhead of the other. The movement of the point rail 60 is driven by points 80, which, in turn, are engaged by a throwbar 90 driven by a stationary switch machine 100.

In operation, vehicle engines are energized via electricity transmitted through the electrically conductive rails of the track. The speed and direction of the vehicle is controlled by the level and polarity, respectively, of the electrical power supplied to the track rails. An operator manually pushes buttons or pulls levers to cause the switches or other electrically operated devices to function, as desired. Such model railway sets are suitable for a single operator, but unfortunately they lack the capability of adequately controlling multiple trains independently. In addition, such model railway sets are not suitable for being controlled by multiple operators.

A digital command control (DCC) system has been developed to provide additional controllability of individual vehicles and other electrical devices. A typical system includes a handheld unit (e.g., a throttle), a digital command station (DCS), and a plurality of devices each comprising an individually addressable digital decoder. The DCS is electrically connected to the train track to provide a command to a particular device (i.e., the device the operator desires to control). The DCS, in turn, may be controlled by a personal computer and/or the handheld device. The address data and the command comprise a set of encoded digital bits sent in the form of square wave packets. A suitable standard for the digital command control system is the protocol established by the National Model Railroad Association DCC Standards, the specification documents of which are hereby incorporated herein by reference. The digital command control, then, enables an operator to individually control different devices of the railway system by using decoders.

Decoders fall into two general categories: mobile decoders, which are designed to control the operations of a vehicle traveling over the railway (e.g., controlling the movement, lights, or sound of the vehicle) and accessory or stationary decoders, which control fixed equipment (e.g., switches railways turnouts, lights, signals, sound, and other immobile animation devices). One popular stationary switch machine is disclosed in U.S. Pat. No. 4,695,016 (Worack), the contents of which are hereby incorporated by reference in its entirety. This slow motion switch machine includes an output pin connected to a swing arm pivotally mounted in a housing and driven by a set of reduction gears. An electric motor drives the gears via a stall current that is low enough to allow the motor to be continuously stalled without damaging it. A printed circuit board provides electrical connections to the motor and auxiliary contacts, which can be opened and closed by a wiper mounted on the swing arm.

In railroad systems, accessory decoders are often used to provide switch routing, i.e., they are capable of operating multiple stationary switch machines in a distinct pattern that forms a route through the switches by issuing one control command. Conventional accessory decoders provide switch routing by locating multiple decoders on a single printed wiring board. This allows a common control to organize routing among the controlled outputs. This approach, however, is limited by the maximum number of outputs that can be located on the wiring board, and by the need to run wiring from the controller to each switch motor. In addition, conventional decoders suffer from other disadvantages. For example, if the train approaches a track section having a misaligned switch (i.e., a switch aligned opposite with respect to the travel direction of the train), a short circuit can result, stopping the train until the switch is correctly aligned. Furthermore, existing accessory decoders only place the stationary switch machine in the position it held at the time of the last power off cycle. Consequently, if a user forgets the last position of the switch, the train may unexpectedly veer off course, causing an accident.

Consequently, there exists a need to provide an accessory decoder that provides a stationary switch machine with multiple switch addresses, senses switch misalignment and repositions the switch correctly, and/or also allows the operator, at his/her option, to control multiple command variables to alter the functionality of the switch.

SUMMARY

Briefly, according to one aspect of the invention, a decoder and sensor are provided for a model railroad stationary switch machine. The decoder connects to a stationary switch machine that changes positions of a track switch connected between a main track section and at least two diverging track sections. The decoder is connected to at least one of the diverging track sections and comprises a controller that is responsive to a command encoded in a square wave signal derived from a signal detected from a rail of at least one of the diverging track sections. The sensor is connected to at least one rail of the main track section to detect when a train occupies the main track section near the track switch so as to generate an output signal that is coupled to the decoder. The decoder is responsive to the output signal from the sensor to inhibit an automatic switch control function of the decoder when a train is determined to be approaching the track switch on at least one of the diverging track sections. From a method perspective, this aspect of the invention is directed to controlling a model railroad stationary switch machine by sensing whether a train occupies a main track section near a track switch that connects between the main track section and at least two diverging track sections. An automatic switch control function for the track switch is inhibited in response to sensing that a train occupies the main track section near the track switch when a train is determined to be approaching the track switch on at least one of the diverging track sections.

According to another aspect of the invention, a decoder for a model railroad stationary switch machine is provided. The decoder comprises a first connector, a second connector and a controller. The first connector connects to a stationary switch machine that changes positions of a track switch in response to control signals from the decoder. The second connector connects to a track section to make electrical contact with a throw rail and a clear rail of the track section and with a throw frog and a clear frog of the track section. The controller is connected to the first and second connectors and is responsive to a command encoded in a square wave signal derived from a signal detected from the throw rail or clear rail. The controller generates the control signals supplied to the stationary switch machine so as to automatically return the track switch to a home position after expiration of a time interval following a decoder-controlled movement of the track switch via the stationary switch machine. From a method perspective, this aspect of the invention is directed to a method for controlling a model railroad track switch comprising changing a position of the track switch; and automatically returning the track switch to a home position after expiration of a time interval following the changing of the track switch position.

BRIEF DESCRIPTION OF THE DRAWINGS

FIGS. 6A and 6B illustrate route configurations (FIG. 6A) resulting from defined primary and secondary address definitions (FIG. 6B).

FIG. 7 provides a listing of exemplary operator definitions for CV variables.

Like reference numerals have been used to identify like elements throughout this disclosure.

DETAILED DESCRIPTION

Figure 1:
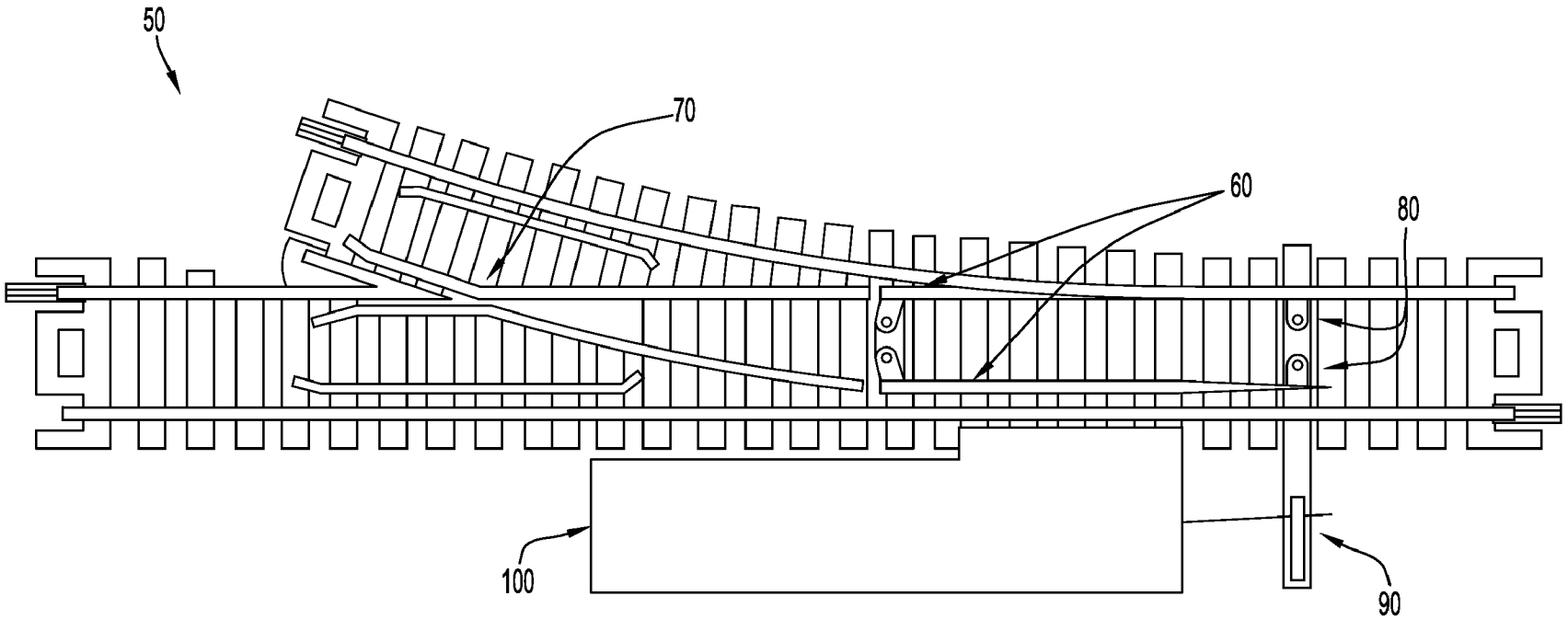
FIG. 1 illustrates a track section from a model railway system, showing a turnout with stationary switch machine.
Figure 2:
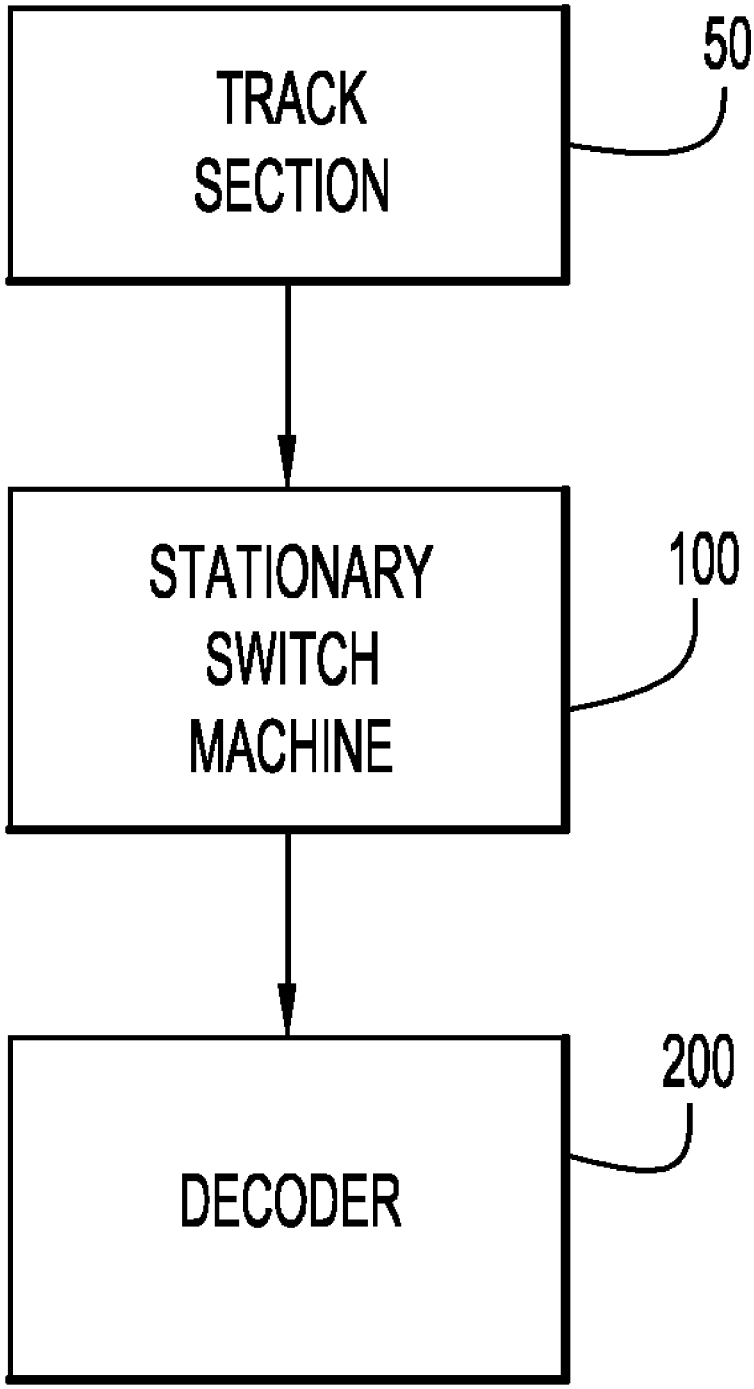
FIG. 2 illustrates is a block diagram of a railway system including the accessory decoder of the present invention.

FIG. 2 is a block diagram of a track system including the decoder of the present invention. As shown, a typical railway system includes a stationary switch machine 100 in communication with an accessory decoder or controller 200 which, in turn, is in communication with a track section 50. The stationary switch machine 100 may include, but is not limited to, stall motor and other motorized devices. By way of specific example, the stationary switch machine 100 may comprise the slow motion switch disclosed in U.S. Pat. No. 4,695,016 (Worack) and sold under the trade name TORTOISE Slow Motion Switch Machine (available from Circuitron Inc., Romeo, Ill.). Briefly, this type of stationary switch machine includes an output pin connected to a swing arm that is pivotally mounted in a housing and driven by a set of reduction gears. A bidirectional motor drives the gears via a stall current that is low enough to allow the motor to be continuously stalled without damaging it. A printed circuit board provides electrical connections to the motor and auxiliary contacts, which can be opened and closed by a wiper mounted on the swing arm. The decoder 200 connects to the circuit board of the stationary switch machine 100. The manner of connection is not particularly limited. For example, wires may be used to connect the stationary switch machine 100 to the decoder 200. Preferably, when the stationary switch machine 100 includes a card edge connector, a mating connector may be provided, enabling the stationary switch machine to plug directly into the decoder 200. The stationary switch machine 100, in addition to connecting to the decoder 200, is mechanically coupled to the track section 50 and/or other fixed devices along the track. For example, the switch machine 100 may be coupled to the track points 80 (FIG. 1), changing the travel path of the train within the rail system.

Figure 3:
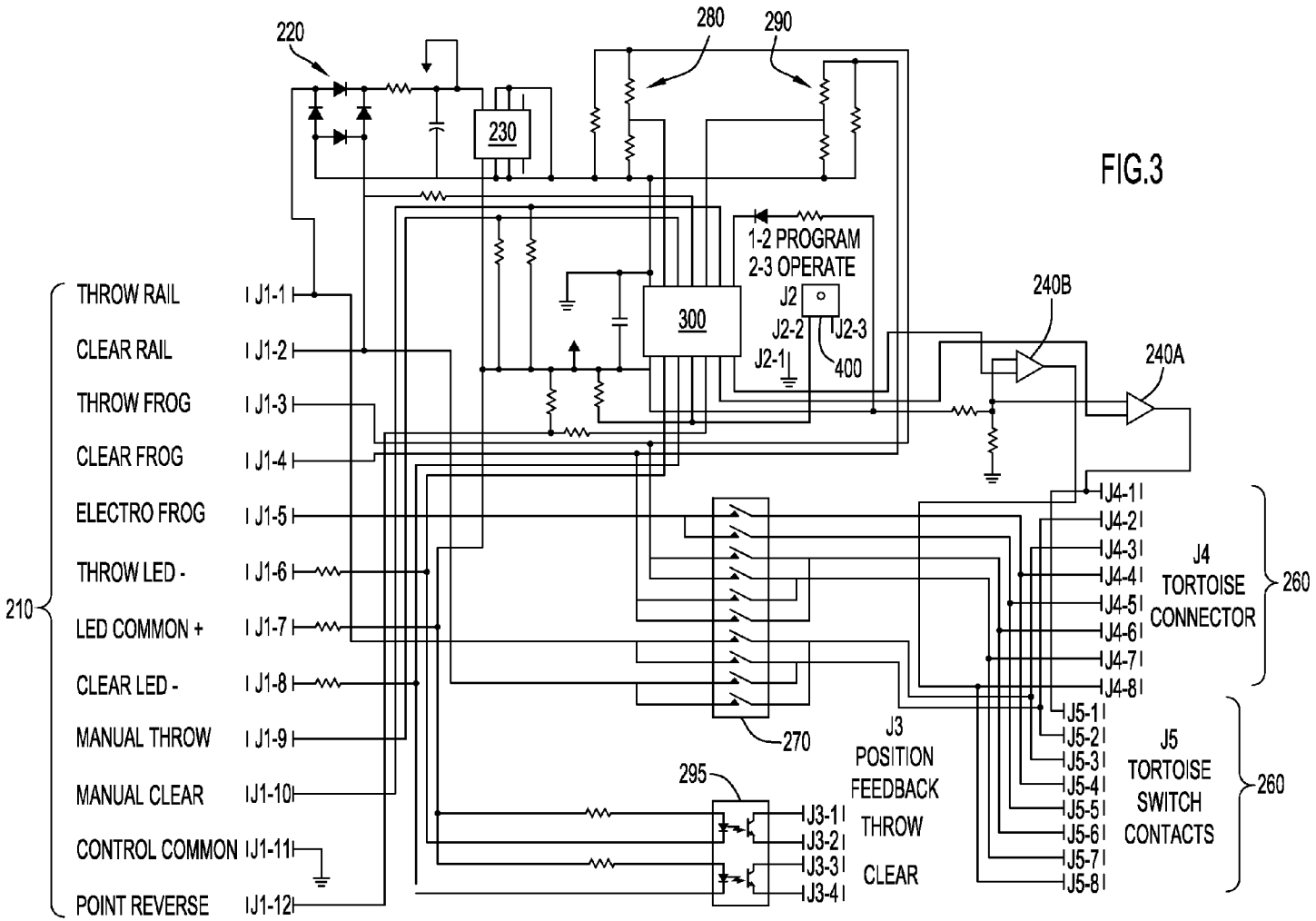
FIG. 3 illustrates a schematic diagram of the electronics assembly of the accessory decoder according to an embodiment of the present invention.
Figure 4:
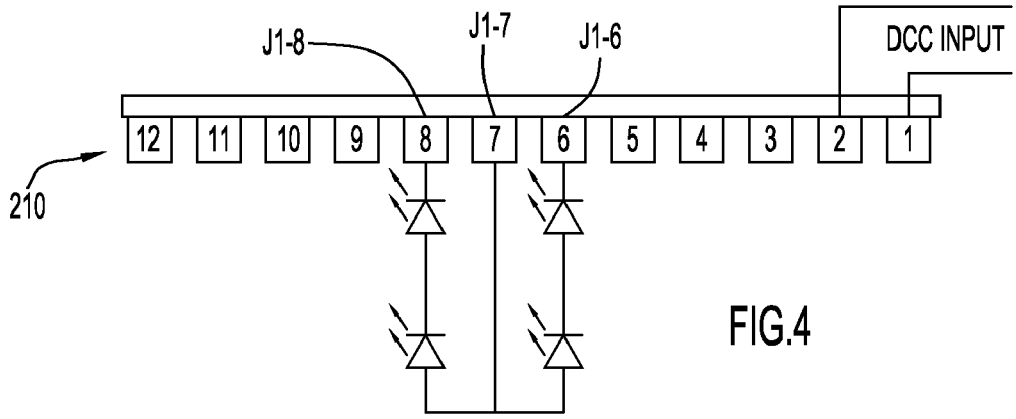
FIG. 4 illustrates a schematic diagram of the electronics assembly of the accessory decoder according to an embodiment of the present invention, showing an LED circuit connected to the output pins.

FIGS. 3 and 4 are schematic diagrams of the accessory decoder 200 according to an embodiment of the present invention. Generally, the decoder 200 includes a plurality of connectors or pins 210, a rectifying diode bridge 220, a voltage regulator 230, an operational amplifier 240A and 240B, a plurality of (output) connector pins 250 (e.g., the card edge connector, discussed above), a plurality of switch contact pins 260, a DIP switch 270, a first resistor network 280, a second resistor network 290, a position feedback connector 295, a microcontroller 300, and a program jumper 400.

The number of input pins or connectors 210 is not particularly limited. As shown in FIG. 3, the decoder 200 may comprise 12 input pins J1-1 to J-12. Pins J1-1 and J1-2 are connected to the throw rail and clear rail, respectively, of the track 50, which is the source of digital command control (DCC) voltage. Pin J1-1 (throw rail) routes unregulated (raw) voltage from the throw rail, through the rectifying diode bridge 220, and to the voltage regulator 230. The voltage regulator 230 regulates the rectified voltage so that it is compatible with the microcontroller 300. By way of example, the voltage regulator 230 may comprise a 5 volt regulator (LM 78L05, available from National Semiconductor, Santa Clara, Calif.). Once rectified, the power is routed from the voltage regulator 230 to the microcontroller 300.

The amplifiers 240A and 240B may comprise a low power dual operational amplifier (LM358AM, available from National Semiconductor, Santa Clara, Calif.). The operational amplifiers 240A and 240B generate two separate outputs that are 180° out of phase from each other. For example, when the output of amplifier 240A comprises a 12 v output, the output of amplifier 240B comprises 0 v, and vice versa. The amplifier 240A routes its output to the connector pins 250 and, specifically, to connector pin J4-1. Similarly, the amplifier 240B routes its output to connector pin J4-8. These connectors J4-1 and J4-8 correspond to motor contacts located on the stationary switch machine 100. As a result, the motor of the stationary switch machine 100 can be driven in one direction or in the opposite direction, depending on the applied polarity of the amplifiers.

In addition to providing power, the clear track rail also transmits data packets, defined by the DCC format, to the decoder 200. The packets include address information, as well as instructions for the addressed decoder. The data is transmitted in the form of a balanced square wave. Input pin J1-2 (clear rail), connected to the microcontroller 300 via R1, routes the square wave to the microcontroller 300, where the DCC encoded data are interpreted.

Input pins J1-1 and J1-2 also route power to the DIP switch 270 (e.g., from the tracks of the rail system). The DIP switch 270 may comprise a 10-position DIP switch (90HBW10PT, available from Grayhill, Inc., Lagrange, Ill.). The DIP switch 270 routes power from the first and second input pins J1-1 and J1-2, through the DIP switch 270, and to the various stationary switch machine connectors 250 (J4-2 to J4-7) as needed, so as to supply power to the power rail sections correctly so the train continues onward. Setting the secondary switches of the DIP switch 270 enables power routing. Each switch may be set to on "ON" or "OFF" position. The configuration of the secondary switches is not particularly limited, so long as the configuration is compatible with the associated stationary switch machine 100. Table 1 illustrates two possible DIP switch configurations, particularly useful for coordinating with the Worack switch machine discussed above, wherein the swing arm is set in either a first swing arm position (first configuration) or a second swing arm position (second configuration).

TABLE I

DIP Switch Configurations

| SECONDARY SWITCH NUMBER ON DIP SWITCH | FIRST CONFIGURATION BASED ON STATIONARY SWITCH MACHINE | SECOND CONFIGURATION BASED ON STATIONARY SWITCH MACHINE |
|---|---|---|
| 1 | ON | ON |
| 2 | ON | ON |
| 3 | ON | OFF |
| 4 | OFF | ON |
| 5 | ON | OFF |
| 6 | OFF | ON |
| 7 | ON | OFF |
| 8 | OFF | ON |
| 9 | ON | OFF |
| 10 | OFF | ON |

Input pins J1-3 (throw frog) and J1-4 (clear frog) route voltage from the so-called trigger rails of the track section 50 to the first resistor network 280 and the second resistor network 290, respectively (discussed in greater detail below). The resistor networks 280, 290 reduce the amplitude of the voltage and diodes at the input of the microcontroller 300 further rectifying the voltage to make it compatible for analysis by the microcontroller 300. The microcontroller 300 monitors the voltage on these pins for the presence or absence of voltage. A voltage will be present when the wheels of a train bridge the gap of the throw frog and clear frog. The microcontroller 300 is configured to detect this voltage- and adjust operational output accordingly (discussed in greater detail below).

The input pin J1-5 (Electro-frog) provides power routing output for an electro-frog type switch.

The output pins J1-6 through J1-8 are contacts for LEDs that the switch may activate, depending on its state. For example, one or more LEDs (e.g., a colored LED such as a green and/or red LED) can be wired in series, as illustrated in FIG. 4. Other wiring configurations, however, may be utilized. The LEDs, furthermore, may be configured to indicate the status of the frog 70 (either thrown or clear).

The input pins J1-9 (manual throw) and J1-10 (clear throw) provide manual operation of the track points 80 via a command override. In operation, when one of the pins is connected to the common (J1-11), the track points 80 will follow the position of the pins J1-9 and J1-10 (i.e., the stationary switch machine 100 will always follow the position of the manual switch). When active/connected, the microcontroller 300 will ignore any serial data commands coming from R1. This is called a "dispatch mode" whereby the decoder ignores DCC signals (i.e., the manual control overrides DCC commands). This enables manual setting of the track points 80 *b* a dispatcher while preventing unexpected point movement caused by other individuals operating the system. For example, the use of a two position, single pole double throw switch (i.e., one set of contacts remains closed in either switch position) will force the track points 80 to always follow the switch position and prevents any DCC control signal from affecting the point position. A second switch in series with the center contact of the first switch may be used to re-enable DCC control.

The input pin J1-12 is for a point reverse function. Whenever this pin is connected to the common (J1-11), the position of the point reverse/switches (providing a push button type reversing functionality).

The position feedback connector (J3) 295 is essentially a repeater that provides an isolated output of the position of the points for use by a computer.

The program jumper 400 enables a user to define a primary address and a route address to each stationary switch machine, as well as to define a plurality of control variables. The jumper 400 includes three pins J2-1, J2-2, and J2-3. When the jumper 400 is connected to J2-2 and J-3, the decoder 200 operates normally. To program the decoder 200, the DCC power source is disconnected, the jumper 400 is repositioned from J2-2/J2-3 to J2-1/J2-2, and then DCC power is connected. This places the decoder 200 in its programming mode (the decoder will remain in programming mode until power is removed, the jumper 400 is connected to J2-2/J2-3, and then power is restored). In the programming mode, a user can program address, route address, and any desired control variable (CV) values, as described hereinafter.

The microcontroller 300 is configured to interpret DCC protocol data received from input pin J1-2, as well as to route commands to the various components of the decoder 200 and to the stationary switch machine 100. The microcontroller 300 may comprise, but is not limited to an 8-Bit CMOS microcontroller (e.g., PIC16F636 microcontroller, available from Microchip Technology, Inc., Chandler, Ariz.). The microcontroller 300 stores software that allows a user to define a plurality of control variables to regulate the operation of the associated stationary switch machine, as will be described hereinafter.

Figure 5:
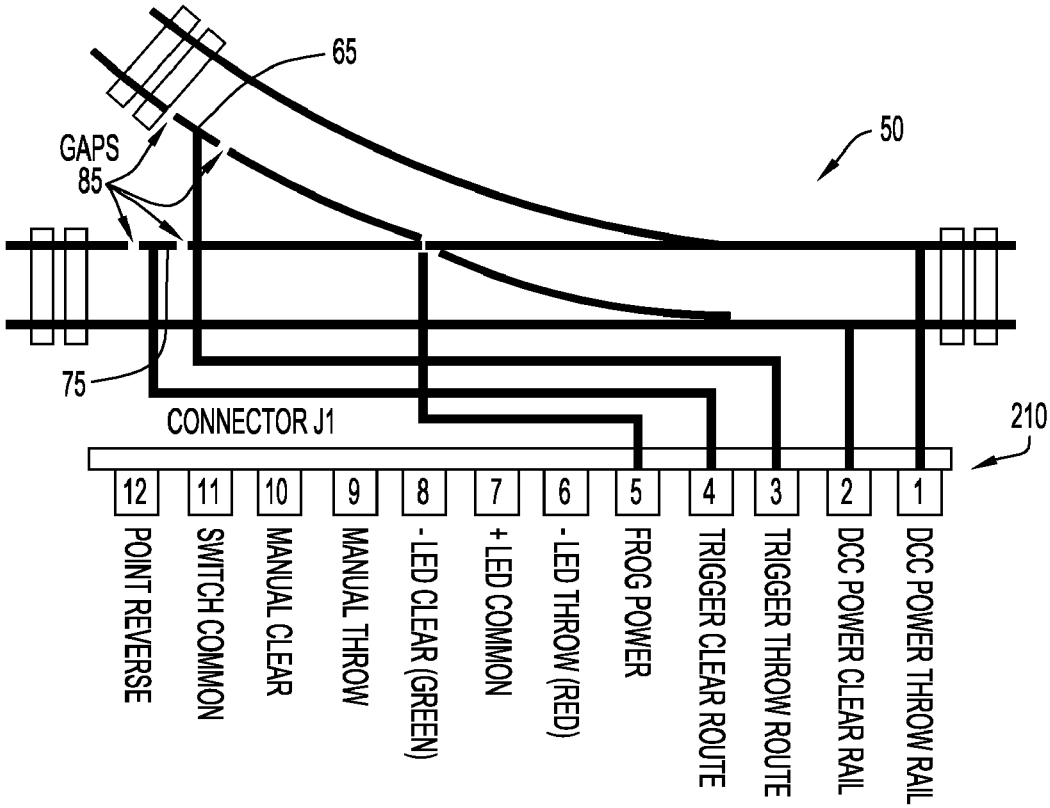
FIG. 5 illustrates a more detailed diagram of a turnout track section and associated switch connectors.

The decoder 200 may be adapted to automatically throw the stationary switch machine 100 when it senses a train approaching a track section 50, engaging the track points 80 to align the point rail 60 and prevent a short circuit. FIG. 5 is a more detailed diagram of a turnout track section associated with the connectors 210. A turnout track section typically includes two rail segments called trigger rails. Specifically, the trigger rails comprise a throw trigger rail 65 and a clear trigger rail 75. The trigger rails 65, 75 are separated by gaps 85 on either side; thus, the trigger rails are short sections of rail completely isolated from the layout power (that is, a short section of rail with an isolating gap 85 at each end). As discussed above, the trigger rails 65, 75 are monitored by the decoder 200 via input pins J1-3 (throw frog) and J1-4 (clear frog).

Normally, the trigger rail aligned with the point rail direction has power routed to it through the stationary switch machine 100 and the DIP switch 270. This enables a train to pass through the points 80 and continue along the track 50. The trigger rail on the misaligned point rail direction, however, is not powered. Consequently, if a train approaches from the misaligned direction, the wheels of the train will bridge the gap 85 between the trigger rail 65, 75 and the non-isolated rail, applying power to the trigger rail through the train. This, in turn, is detected by the microcontroller 300, which initiates movement of the track points 80 to correctly align with the train. Since there is no power applied to the trigger rail, the train may stop until the points 80 are correctly positioned and power is applied via the switch machine 100 and the DIP switch 270. Thus, the decoder 200 according to the present invention senses the switch misalignment as the train approaches, positions the switch correctly, and supplies power to the previously non-powered rails. This allows continued operation of the train through the switch, preventing the interruption of travel.

FIG. 5 further shows the preferred connections for the automatic throw function described above. While the trigger rails 65, 75 are shown as short sections, they may be any desired length. Once the stationary switch machine 100 is wired, the power routing switches of the DIP switch 270 may be set to the desired configuration. The connections are preferably used with an electrofrog as described above. Alternatively, other types of frog rail configurations may be used, such as an insulated frog configuration. When an electrofrog configuration is used, the connection from J1-5 may be omitted.

As discussed above, DCC signals comprise square wave packets including address and command data. To receive a command, the decoder 200 includes a primary DCC address that can be programmed with the digital command system. In addition, the decoder 200 may be programmed to receive secondary addresses that can be used to define operated-specified routes. These route addresses allow an operator to configure a group of stationary switch machines 100 with the same address that selectively respond to a single command. Thus, one command may be sent to the group, generating switch-specific output and defining a route within a railway system.

In operation, the default primary address of the decoder 200 is set to 1 (but a primary address may comprise any number between 1 and 2044). To program the primary address of the decoder 200 (and thus, of the stationary switch machine 100 associated with the decoder), the program jumper 400 is set to its programming position as described above. The primary address is then defined by issuing a command through the DCS and/or the handheld device (throttle). Specifically, once the address program is activated, the next command issued by the DCS will be stored as the primary address of the specified stationary switch machine 100. To issue the primary address, the address on a throttle is selected, and a clear or throw command is issued.

The route address is defined in a similar manner. The default route address is set to 2044 (but a route address may comprise any number between 1 and 2044). After the primary address (which is the first address) is set, the same procedure is followed, with a route address value being chosen and a clear or throw command being issued. The number of primary and secondary addresses is not particularly limited. For example, the decoder 200 may provide one or more primary addresses and a plurality of route addresses associated with each primary address. By way of specific example one or two primary addresses and 13 route addresses associated with each primary address may be provided.

This configuration allows each decoder 200 to respond to more than one address. A route is enabled by programming the route address to each decoder 200 and configuring it to execute a particular command (e.g., a switch direction, a throw command, and/or a clear command) when addressed. This allows an operator to define a route using an unlimited number of decoders (and their associated stationary switch machines 100), since each decoder selectively responds to a defined route address. Essentially, the decoder 200 functions to allow an operator to form a network of specific track switches without requiring the use of common controller or a nest of wires extending from a common point to an array of track switches, which is required with current decoders.

Figure 6A:
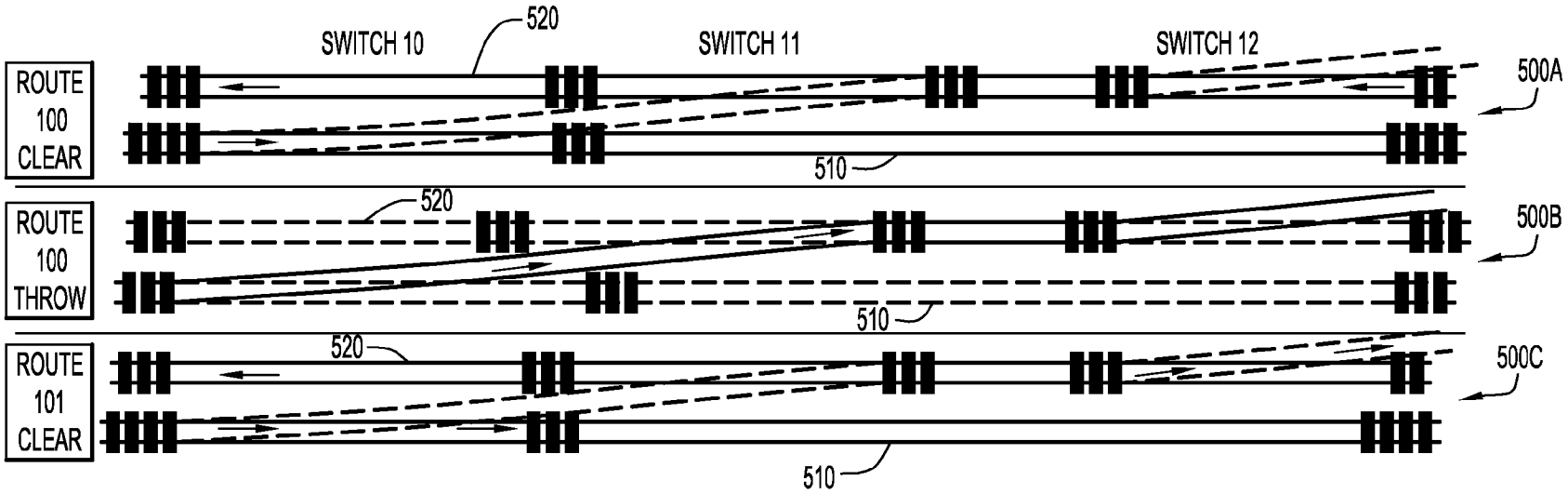

The route address function is further explained with reference to FIGS. 6A and 6B. Three different track systems 500A, 500B, 500C are provided. Each track system 500A, 500B, 500C includes a first mainline track 510 running parallel to a second mainline track 520. In addition, each track system 500A, 500B, 500C includes three stationary switch machines assigned a primary address, and each switch machine is associated with a corresponding track switch. Specifically, the primary address of the left-most switch machine is 10, the primary address of the middle switch machine is 11, and the primary address of the right-most switch machine is 12. All three switch machines are also assigned a route address. In route address 100 and 101, Switch machine 10 and Switch machine 11 are each sent the same operation commands. Switch machine 12, however, is sent an operation command in route address 100 that differs from the command sent in route address 101.

In the first track system 500A set (Route 100 Clear), the decoder 200 has set the switch machines 100 to clear (all the points (not shown) are aligned); consequently, the train has a clear travel path along both mainline tracks 510, 520. In the second track system 500B (Route 100 Throw), the decoder 200 has thrown all the switch machines 100. As a result, the point rail is positioned to direct traffic off the mainline. This defines a route beginning from the first mainline track 510 (Switch 10), across the second mainline track 520 (Switch 11), and then onto another divergent route from the second mainline (Switch 12). In the third track system 500C (Route 101 Clear), the decoder 200 sets Switch 10 and Switch 11 to throw, but reverses the throw on Switch 13 (effectively setting Switch 13 to clear). As illustrated in 6A, this provides a route that begins from one mainline and crosses over to the other mainline, with no other diverging paths.

Referring to FIG. 6B, to align the switch machines as shown in the first track system 500A, the decoder 200 at each switch machine 100 is issued a Clear command to address 100. All three switch machines 100 will align to the clear position. To align the switch machines 100 as shown in the second track system 500B, the decoder issues a Throw command to address 100. All three switch machines 100, consequently, move to the throw position. To align the switch machines 100 as shown in the third track system 500C, the decoder issues a Throw command to address 101. Switch 10 and Switch 11 move to the throw position, but Switch 12 moves to the clear position because the decoder 200 instructs Switch 12 to execute the reverse command, as defined by the programmed CV value. As can be seen, various switch arrangements can be accessed by programming differing routes addresses. For each switch, the switch points will follow the decoder command any time that the primary address is accessed.

In addition, the decoder 200 may be programmed with other command or control variables (CVs) to issue commands that alter the functionality of its associated stationary switch machine 100. Below are examples of CVs that can be programmed into the decoder 200 at a particular address, acceptable values to program, and the operation each value performs.

CV49 may be used to control which direction the decoder 200 sees as the Clear and Thrown switch positions. The variable may include the values of 0 (default) or 1. A value of 0 will cause the decoder to operate as normal, and a value of 1 will cause the decoder 200 to respond in reverse of default operation.

CV50 to CV62 may be used to indicate the Clear or Thrown Switch Positions of the route address for a track section (e.g., a turnout). The variables may accept values of 0 (default), 1, 2, or 3. A value of 0 will cause the points of the track to move in the commanded direction of the DCS. A value of 1 will cause the points to move in the direction opposite the commanded direction of the DCS. A value of 2 will cause the points to always move to the Thrown position, regardless of the commanded direction of the DCS. A value of 3 will cause the points to always move to the Clear position, regardless of the commanded direction of the DCS. These variables permit a user to define routes that can be activated in both directions, or that have a route that throws only in one direction, eliminating the need to remember which route takes which command.

As mentioned above, CV63 functions to indirectly set the primary address and the 13 (secondary) route addresses during initial address setting, as well as to reset all addresses and CVs to their factory default values in CV programming. CV63 defaults to 0 when the program jumper is moved to enter the address setting mode and automatically advances from 0 to 13 as the addresses are entered. A value of 0 points to the primary address and 1 to 13 point to the route addresses.

CV64 may set the position of the points when power is turned on. The variable may accept values of 0, 2, or 3. A value of 0 will cause the decoder 200 to ensure that the points are in the same position as the last point movement command before power was removed from the layout. A value of 2 will cause the decoder 200 to move to the Clear position when power is applied. A value of 3 will cause the decoder to move to the Thrown position when power is applied.

CV65 may set speed of the points 80 (FIG. 1) on the track section 50. A stationary switch machine 100 may be designed to move the points 80 at a set (default speed). For example, a slow motion switch controls the speed of the track points, moving them at a slow rate of speed. Under certain situations, however, it is desirable to move the track points 80 at a rate of speed different than the default speed of the stationary switch machine 100. CV65 functions to alter the speed control of the stationary switch machine 100. The variable may include values of 0 to 15 (default). A value of 15 will move the points at normal (full) speed (e.g., about 2 seconds transit time for a slow motion switch). A value of 0 will move the points at the slowest speed (e.g., about 12 seconds). Intermediate values move the pins at proportionally faster or slower speeds. With this command variable, an operator has the ability to adjust the speed of the point movement to a desired level.

When a dispatcher (override) mode is activated (described above), CV66 disables the function that automatically throws the switch when a train is approaching misaligned points (described above). The variable includes values of 0 (default) and 1. A value of 0 will allow auto throw to operate as normal when the dispatcher mode is enabled. A value of 1 will turn off the auto throw when the dispatcher mode is enabled. This provides an operator with the option of selectively activating the auto throw function when the dispatcher is in control and the DCC commands are locked out. When enabled, auto throw will correct an incorrectly set switch, but the points and the manual control can then be out of synch. If the auto throw function is disabled, the dispatcher is in full control of position points 80, and, as such will not correct a misaligned point. The auto throw function will be enabled when the dispatcher mode is terminated.

CV67 allows an operator to set a variable time after an auto throw event during which the auto throw function is disabled. When the programmed time period expires, the auto throw function is enabled and operates normally. The variable includes values of 0 (default) to 255. Thus, at 0, the auto throw function is immediately active after the auto throw event (i.e., it will allow the auto throw to function any time the auto throw is enabled (see CV66)). At 255, the auto throw function is disabled 255 seconds after the auto throw event. Intermediate values disable the auto throw function for proportionally longer or shorter times. With this configuration, an operator has the option of, after any auto throw event (i.e., anytime the auto throw function moves the points), of allowing another auto throw operation immediately after completion of the point movement or to disable the auto throw function for a specified period of time (1 to 255 seconds) after the points finish moving. The timed inhibit is used may be used to resolve conflicts caused by two trains tripping an auto throw request at the same time. For example, this function may be used in situations where a train could bridge two auto throw trigger sections (or an approaching train could move the points under a train already occupying the switch). The first auto throw would align the points correctly, but the second one could throw the points under the train causing a wreck. The timer gives the first train present control of the points and allows the second train control of the points only after a specified time delay during which the first train can clear the switch.

CV68 may enable crossing gate (semaphore) operations. The variable includes values of 0 (default) and 1. A value of 0 will activate all normal control functions of the decoder 200. A value of 1 activates the semaphore mode. In this mode, the throw trigger rail, when tripped, will move the stationary switch machine 100 to the throw position and turn on the red LED output. If the clear trigger rail is tripped, the stationary switch machine 100 will move to the Clear position and turn on the green LED output.

The above CVs may be programmed via the DCS of the DCC system (e.g., by using the Program-on-the-main function of a DCC command station). FIG. 7 is an exemplary listing an operator can use to record CV variables.

Figure 8:
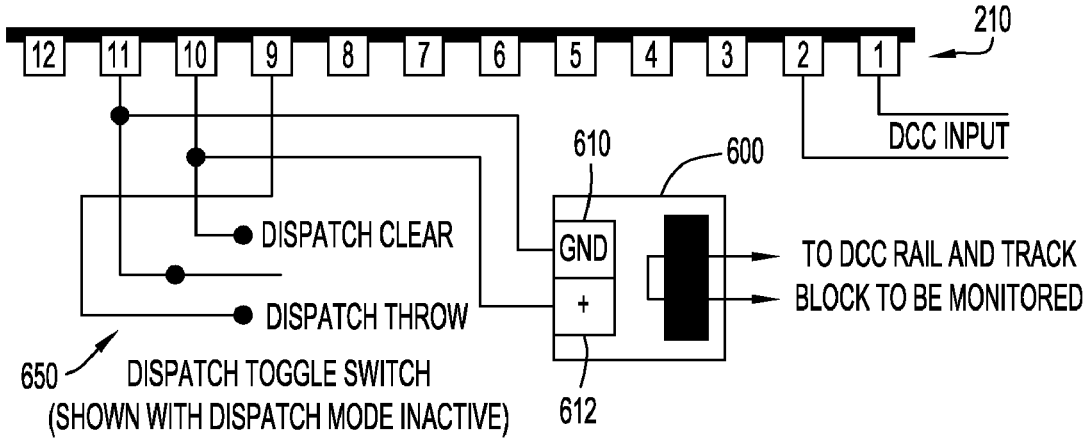
FIG. 8 is a block diagram of a connector portion of the decoder connected to a block detector according to a further embodiment of the invention.
Figure 9:
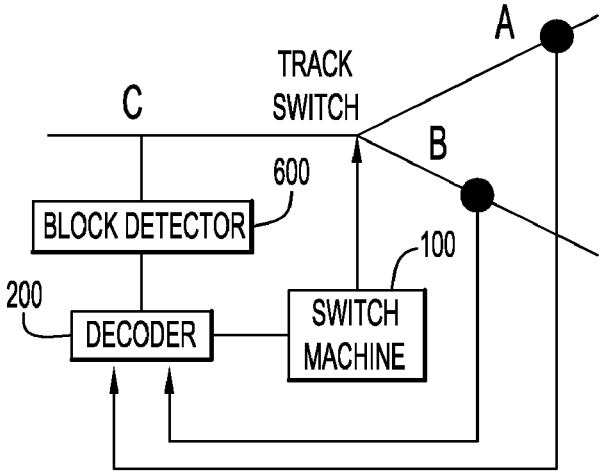
FIG. 9 is a block diagram of the decoder and block detector and associated track sections showing an exemplary operation for the embodiment shown in FIG. 8.

Turning to FIGS. 8 and 9, a further aspect of the invention is described. Under some conditions, a user may want to prevent auto-throw or some other function of the decoder when a train is occupying a track block or mainline track section. One example of such a situation is shown in FIG. 9 where there are diverging track sections A and B that connect to track block C. It may be desirable to prevent a train from one of the diverging track sections A or B from tripping the auto-throw function of the decoder if there is a train occupying the mainline block C near the switch. This prevents the lower priority train on one of the diverging track sections A or B from moving the switch points under the train on the mainline track.

This function can be accomplished by using a block detector with an open collector output, as shown at reference numeral 600. An example of a suitable block detector device is the BD-20 marketed by NCE Corporation. However, any block detector with an open collector output that is isolated from the track power is suitable. The block detector 600 is normally used to indicate the presence of a locomotive, caboose or other rolling stock in a track section by sensing electrical current drawn by that rolling stock. Locomotives will naturally trigger the block detector 600 because they draw current through their DCC decoder.

The block detector 600 is connected to the DCC rail and track of the block of track (e.g., track block C) to be monitored for purposes of disabling the auto-throw function on connecting diverging tracks, e.g., track sections A and B. The outputs of the block detector 600 comprise a ground terminal and an open collector (+) terminal shown at 610 and 612. The ground terminal of 610 is connected to pin 11 of the connector 210 of the decoder and the open collector (+) terminal of 612 is connected to pin 10 of the decoder. The decoder 200 may also be connected to diverging track sections A and B and responsive to DCC signals detected from those track sections.

In operation, whenever a train occupies the track block that is monitored by the block detector 600, the decoder 200 will enter the Dispatch Mode and move the switch points to the clear position. In the Dispatch Mode, CV66 specifies which functions are inhibited. Setting bit 0 inhibits DCC operation, bit 1 inhibits the auto-throw function, and bit 2 inhibits the manual throw function. The default is that all functions are inhibited during the Dispatch Mode. The connections shown in FIG. 8 will force the switch to clear when the block is occupied. However, if the connection between the open collector (+) terminal 612 of the block detector 600 is connected to pin 9 instead of pin 10, this forces the points of the switch to the throw position when the monitored block is occupied with the same Dispatch Mode lockouts as for the wiring shown in FIG. 8.

Furthermore, FIG. 8 shows a dispatcher toggle switch 650 in the center off (inactive) position, indicating that the dispatcher is not in control. If the dispatcher switch is active, then the dispatcher switch will control the position of the points regardless of the status of the block detector 600. Triggering the block detector 600 while the dispatcher switch is active may result in any attached signal lights turning off then on, but the position of the points will follow the dispatcher switch. Thus, the decoder is responsive to positions of the toggle switch 650 such that when the toggle switch is in a first or second position (active positions), the decoder allows the toggle switch to control the track switch regardless (and overriding) the output signal produced by the sensor (block detector 600). On the other hand, when the toggle switch is in a third position, the decoder is not responsive to the toggle switch and instead is responsive to the output signal from the sensor. If a user does not want any interaction between the block detector 600 and the dispatcher switch 650, a switch (or a set of switch contacts on the dispatcher switch) may be used to open-circuit the ground terminal of the block detector 600 when the dispatcher switch is active.

Thus, to summarize, the feature depicted in FIGS. 8 and 9 can be summarized as follows. A sensor (the block detector 600) and a decoder are combined for use with a model railroad stationary switch machine. The stationary switch machine changes positions of a track switch connected between a main track section and at least two diverging track sections. The decoder is connected to the stationary switch machine and to at least one of the diverging track sections. The decoder comprises a controller (microcontroller 300) that is responsive to a command encoded in a square wave signal (e.g., DCC signal) derived from a signal detected from a rail of at least one of the diverging track sections. The sensor is connected to at least one rail of the main track section to detect when a train occupies the main track section near the track switch so as to generate an output signal that is coupled to the decoder. The decoder is responsive to the output signal from the sensor to inhibit an automatic switch control function of the decoder when a train is determined to be approaching the track switch on at least one of the diverging track sections.

From an operational or methodology perspective, the feature depicted by FIGS. 8 and 9 can be summarized as a method for controlling a model railroad stationary switch machine, comprising: sensing whether a train occupies a main track section near a track switch that connects between the main track section and at least two diverging track sections; and inhibiting an automatic switch control function for the track switch in response to sensing that a train occupies the main track section near the track switch when a train is determined to be approaching the track switch on at least one of the diverging track sections.

A further feature of the invention, called Auto Return, is now described. This feature returns the track switch points to a defined position after a fixed time interval. It is controlled by three CVs of the decoder, for example, CV64, CV69 and CV70 according to one embodiment. CV64 determines the "home" position of the points. The home position is the position to which the decoder 200 will return the points after the desired waiting period following a decoder-controlled point movement of the track switch associated with the stationary switch machine. If the value at CV64 is 0 (the default), the decoder returns the points to the clear position. A value of 2 causes the decoder to return to the clear position and set the points to clear at power on. A value of 3 causes the decoder to return the points to the throw position and set the points to throw at power on. CV70 sets the delay time between the start of the point movement and when the decoder automatically returns the points to the programmed position. The value entered into the CV70 is the desired delay in seconds. Values of 1 through 255 are valid, and the default value is 15. The final Auto Return control CV is CV69 that determines which functions will activate Auto Return. When the value of CV69 is 1, the decoder enables Auto Return after a DCC command, a value of 2 enables Auto Return after an auto-throw, a value of 4 enables Auto Return after a manual pushbutton operation, and a value of 8 enables Auto Return in the Semaphore Ops mode. A user may enable multiple Auto Returns by adding the individual numbers together to get the final CV value (e.g. 15 will enable Auto Return after any track switch points movement).

Thus, the Auto Return feature can be summarized by a decoder for a model railroad stationary switch machine, comprising a first connector for connecting to a stationary switch machine that changes positions of a track switch in response to control signals from the decoder and a second connector for connecting to a track section to make electrical contact with a throw rail and a clear rail of the track section and with a throw frog and a clear frog of the track section. The decoder comprises a controller that is connected to the first and second connectors and is responsive to a command encoded in a square wave signal derived from a signal detected from the throw rail or clear rail. The controller generates the control signals supplied to the stationary switch machine so as to automatically return the track switch to a home position after expiration of a time interval following a decoder-controlled movement of the track switch via the stationary switch machine. The controller is programmable to determine the home position and a duration of the time interval, and may be further programmable to determine which decoder functions are followed by automatically returning the track switch to the home position.

From an operational or methodology perspective, the Auto Return feature can be summarized as a method for controlling a model railroad stationary switch machine, comprising changing a position of the track switch; and automatically returning the track switch to a home position after expiration of a time interval following the changing of the position of the track switch.

Although the decoder 200 is shown as being separate from the stationary switch machine 100, it should be understood to one with ordinary skill in the art that that the decoder 200 and its features and functions described herein may be integrated into the stationary switch machine 100.

While the invention has been described in detail and with reference to specific embodiments thereof, it will be apparent to one skilled in the art that various changes and modifications can be made therein without departing from the spirit and scope thereof. For example, it is to be understood that terms such as "top", "bottom", "front", "rear", "side", "height", "length", "width", "upper", "lower", "interior", "exterior", "inner", "outer", and the like as may be used herein, merely describe points of reference and do not limit the present invention to any particular orientation or configuration. Thus, it is intended that the present invention covers the modifications and variations of this invention that come within the scope of the appended claims and their equivalents.

We claim:

1. In combination, a sensor and a decoder providing switch control functions for a model railroad stationary switch machine that changes positions of a track switch connected between a main track section and at least two diverging track sections, the combination comprising:

a first decoder connector connecting the decoder to the stationary switch machine;

a second decoder connector connecting the decoder to at least one of the diverging track sections and making electrical contact with a trigger rail of that diverging track section, the trigger rail comprising a short section of rail that has a gap on each end from an adjacent rail such that the trigger rail is completely electrically isolated from power to a track layout;

the decoder further comprising a microcontroller connected to said first and second connectors to monitor a presence or absence of voltage at the trigger rail, wherein the presence of voltage at the trigger rail is caused by a train wheel bridging a said gap, the microcontroller receiving a position signal via the first connector representing a current position of the track switch to generate control signals to the stationary switch machine via said first connector to position the track switch under control by the stationary switch machine to correctly align with the train based on the presence of voltage received through the second connector and the current position of the track switch; and connections connecting the sensor between at least one rail of the main track section and the decoder to detect when a train occupies the main track section near the track switch and provide an output signal to the decoder;

wherein the decoder is responsive to said output signal from the sensor to inhibit an automatic switch control function of the decoder when a train is determined to be approaching said track switch on at least one of said diverging track sections.

2. The combination of claim 1, wherein the decoder is responsive to said output signal to inhibit an automatic throw function that would otherwise allow a train on either of the diverging track sections to automatically trigger the switch machine to correct for misalignment of points of the track switch so as to permit a train on either of the diverging track sections to enter the main track section.

3. The combination of claim 1, wherein said microcontroller is programmable to determine which of several automatic switch control functions of the decoder are inhibited in response to the output signal from the sensor, including one or more of DCC operation, an auto-throw function and a manual throw function.

4. The combination of claim 1, wherein said decoder is responsive to the output signal from the sensor to automatically move the track switch to a clear position or to automatically move the track switch to a throw position.

5. The combination of claim 1, and further comprising a toggle switch connected to said decoder, and wherein said decoder is responsive to positions of said toggle switch such that when said toggle switch is in a first or second position, the decoder allows said toggle switch to control said track switch regardless of the output signal produced by said sensor when said toggle switch is in a first position, and when said toggle switch is in a third position the decoder is not responsive to said toggle switch and instead is responsive to the output signal from said sensor.

6. The combination of claim 1, wherein the position signal is a square wave, wherein the microcontroller stores user programmable values for each of a plurality of addresses and a command variable associated with a corresponding address that indicates a particular function to be initiated, and wherein the microcontroller generates a control signal associated with a particular address value when the command derived from the square wave position signal corresponds to said particular address value.

7. The combination of claim 6, wherein the microcontroller is responsive to a manually generated throw or clear input signal supplied via an input connection interface to cause said stationary switch machine to assume a throw or switch position and to ignore any commands that may be present in the square wave position signal detected while said throw or clear input signal is set.

8. The combination of claim 1, wherein said decoder and its function are integrated into said switch machine.

9. In combination, a sensor and a decoder providing switch control functions for a model railroad stationary switch machine that changes positions of a track switch connected between a main track section and at least two diverging track sections, the combination comprising:

a first decoder connector connecting the decoder to the stationary switch machine;

a second decoder connector connecting the decoder to at least one of the diverging track sections and making electrical contact with a trigger rail of that diverging track section, the trigger rail comprising a short section of rail that has a gap on each end from an adjacent rail such that the trigger rail is completely electrically isolated from power to a track layout;

the decoder further comprising a microcontroller connected to said first and second connectors to monitor a presence or absence of voltage at the trigger rail, wherein the presence of voltage at the trigger rail is caused by a train wheel bridging a said gap, the microcontroller receiving a position signal via the first connector representing a current position of the track switch to generate control signals to the stationary switch machine via said first connector to position the track switch under control by the stationary switch machine to correctly align with the train based on the presence of voltage received through the second connector and the current position of the track switch; and connections connecting the sensor between at least one rail of the main track section and the decoder to detect when a train occupies the main track section near the track switch and provide an output signal to the decoder;

wherein the decoder is responsive to said output signal from the sensor to inhibit an automatic switch control function of the decoder when a train is determined to be approaching said track switch on at least one of said diverging track sections;

wherein said microcontroller is programmable to determine which of several automatic switch control functions of the decoder are inhibited in response to the output signal from the sensor, including one or more of DCC operation, an auto-throw function and a manual throw function; and wherein said decoder is responsive to the output signal from the sensor to automatically move the track switch to a clear position or to automatically move the track switch to a throw position.

10. The combination of claim 9, and further comprising a toggle switch connected to said decoder, and wherein said decoder is responsive to positions of said toggle switch such that when said toggle switch is in a first or second position, the decoder allows said toggle switch to control said track switch regardless of the output signal produced by said sensor when said toggle switch is in a first position, and when said toggle switch is in a third position; the decoder is not responsive to said toggle switch and instead is responsive to the output signal from said sensor.

11. The combination of claim 10, wherein the position signal is a square wave, wherein the microcontroller stores user programmable values for each of a plurality of addresses and a command variable associated with a corresponding address that indicates a particular function to be initiated, and wherein the microcontroller generates a control signal associated with a particular address value when the command derived from the square wave position signal corresponds to said particular address value.

12. The combination of claim 11, wherein the microcontroller is responsive to a manually generated throw or clear input signal supplied via an input connection interface to cause said stationary switch machine to assume a throw or switch position and to ignore any commands that may be present in the square wave position signal detected while said throw or clear input signal is set.

* * * * *